US007874023B1

(12) United States Patent
Sundling

(10) Patent No.: US 7,874,023 B1
(45) Date of Patent: Jan. 25, 2011

(54) INFLATABLE SAFETY SWIMMING POOL COVER

(76) Inventor: Andy P. Sundling, 506 Park Ave., Belvidere, IL (US) 61008

( * ) Notice: Subject to any disclaimer, the term of this patent is extended or adjusted under 35 U.S.C. 154(b) by 792 days.

(21) Appl. No.: 11/903,827

(22) Filed: Sep. 24, 2007

Related U.S. Application Data

(60) Provisional application No. 60/846,264, filed on Sep. 22, 2006.

(51) Int. Cl.
*E04H 4/00* (2006.01)

(52) U.S. Cl. ..... 4/499; 4/498; 4/503

(58) Field of Classification Search ..... 4/498, 4/499, 503

See application file for complete search history.

(56) References Cited

U.S. PATENT DOCUMENTS

| | | | | |
|---|---|---|---|---|
| 1,838,086 | A * | 12/1931 | Farnstrom | 441/131 |
| 3,355,745 | A * | 12/1967 | Jannuzzi | 4/503 |
| 4,685,254 | A | 8/1987 | Terreri | |
| 4,825,479 | A | 5/1989 | Bonneau | |
| 4,953,239 | A | 9/1990 | Gadsby | |
| 4,976,642 | A * | 12/1990 | Wilkie | 441/131 |
| 5,144,704 | A | 9/1992 | Genzel et al. | |
| D330,087 | S | 10/1992 | Mejias, Jr. | |
| 5,901,503 | A | 5/1999 | Dalene et al. | |
| 6,052,843 | A * | 4/2000 | Pirillo | 4/498 |
| 6,280,271 | B1 * | 8/2001 | Peterson | 441/40 |
| 6,286,157 | B1 | 9/2001 | Baumann | |
| 6,408,453 | B1 * | 6/2002 | Song et al. | 4/506 |
| D470,210 | S | 2/2003 | Rodriguez et al. | |
| 6,607,166 | B1 * | 8/2003 | Pichkhadze et al. | 244/138 R |
| 6,694,539 | B1 | 2/2004 | Kordell et al. | |
| 2009/0151065 | A1 * | 6/2009 | Watson | 4/503 |
| 2009/0158517 | A1 * | 6/2009 | Herd et al. | 4/499 |

* cited by examiner

*Primary Examiner*—Khoa D Huynh
(74) *Attorney, Agent, or Firm*—Montgomery Patent and Design; Robert C. Montgomery

(57) ABSTRACT

A system and method for an inflatable swimming pool cover that is elevated above the water line, particularly for above ground pools, is herein disclosed. The cover is configured with a donut-shaped air pillow around a higher center air pillow. The donut-shaped air pillow maintains the cover above the levels of the pool sidewalls such that rain, snow, leaves and the like are directed off the pool cover to the ground, thus eliminating unwanted debris from accumulating on the cover. Further, since no water can collect on the pool cover, the risk of drowning by young children or pets that may accidentally be trapped upon or within the pool cover is significantly reduced. The two air pillows are interconnected with a tube structure and also an air filling tube that extends to the side of the pool to allow the air pillows to be filled or refilled from the perimeter. A plurality of straps secures the pillows in place to the underside of the pool cover.

2 Claims, 3 Drawing Sheets

INFLATABLE SAFETY SWIMMING POOL COVER

RELATED APPLICATIONS

The present invention was first described in and claims the benefit of U.S. Provisional Application No. 60/846,264, filed Sep. 22, 2006, the entire disclosures of which are incorporated herein by reference.

FIELD OF THE INVENTION

The present invention relates generally to an inflatable swimming pool cover that is elevated above the water line specifically for above ground pools and, more particularly, to the cover having a plurality of air pillows and a donut-shaped ring around a higher center air pillow that causes rain, snow, leaves and the like to drain off the pool cover to the ground for a safe environment.

BACKGROUND OF THE INVENTION

Above ground swimming pool owners who live in areas that require that they cover their pools during the winter months know all too well of the burdens associated with such maintenance. The existing covers are usually anchored around the pool perimeter and supported in the pool by balloon-like floats. The floating supports tend to either deflate or move about resulting in sagging portions that collect leaves, branches and water. As a result, the pool owner must constantly adjust the cover, re-position and inflate the floats, and tighten the perimeter anchoring. Further, the cover can become damaged and torn due to the excessive stress created by the collected water and debris. Ultimately, the cover needs to be replaced prematurely and at a considerable cost. Another identified problem is that existing covers' often trap water posing a potential drowning hazard to children and pets. The development of the invention and system herein described fulfills this need.

Although the invention resembles a conventional above ground pool cover, the invention has a donut-shaped ring around a higher center air pillow and a plurality of other inflatable pillows. In this manner the pool cover is kept above the levels of the sidewalls of the pool causing any rain, snow, leaves or the like simply fall of the pool cover and onto the ground. Leaves, water and unwanted debris are unable to accumulate on the cover. Additionally, since no water is present on the cover of the pool, the risk of drowning by young children or pets that may access the pool cover area is greatly reduced. The pillows are interconnected with a tube structure that extends to the side of the pool to allow it to be filled or refilled from the perimeter. Finally, a series of straps hold the pillows in place to the underside of the pool cover. The use of the innovative above ground pool covering apparatus and system allows pool owners to keep rain, snow, leaves, and other debris off of their above ground pool cover over the winter months while providing a safer environment for children and pets.

Several attempts have been made in the past to cover and protect a swimming pool, especially during extended periods of inactivity. U.S. Pat. No. 4,685,254 in the name of Terreri discloses a pool cover support comprising a balloon for placement on the surface of the water in a swimming pool, an air hose with one end attached to said balloon and another attached to a valve, that when during an inflation, the balloon can raise a pool cover to prevent build-up of unwanted debris thereon the pool cover. Unfortunately, the Terreri device does not provide a tie-down means to secure the pool cover via ropes or strapping to an exterior location. Additionally, the present invention utilizes a secondary outer ring pillow as well as a center pillow with air distribution conduits evenly distributing the pressurized air from an air supply source thereto both outer ring and center pillows.

U.S. Pat. No. 4,825,479 in the name of Bonneau teaches a inflatable swimming pool cover adapted to become arched over the pool when air under pressure is projected under the cover, having a skirt adapted to hang in the water adjacent to a peripheral side wall with a series of holes that bleed air in order to maintain the cover at a desired height. The Bonneau device differs in scope from the present invention in that a constant supply of pressurized air must be introduced to the cover, thereby increasing energy consumption and maintenance.

U.S. Pat. No. 4,953,239 in the name of Gadsby describes an inflatable swimming pool cover which, when installed and inflated with a blower, floats on a water surface and has a bulbous surface raising above the swimming pool perimeter. Unfortunately, the Gadsby device also depends on a constant supply of pressurized air must be introduced to the cover, thereby creating the same energy consumption and maintenance problems as in the Bonneau device.

U.S. Pat. No. 5,144,704 in the name of Genzel et al. discloses a swimming pool cover with multiple air compartments which are fixed in location with respect to each other, which may be interleaved with laterally overlapping portions. The cover also comprises a removable exterior portion which is exposed for cleaning and maintenance. The Genzel et al. device differs in scope from the present device in that it does not provide for a center pillow and an annular-shaped outer ring pillow interconnected with a plurality of air distribution conduits, all attached via attachment straps thereto an encompassing pool cover, which incorporates means by which a user can securely tie-down to an exterior location.

None of the prior art particularly describes a swimming pool cover, particularly for above-ground pools, that can be inflated with an air supply source into a protective cover having an outer ring pillow and air distribution conduits channeling pressurized air into a center pillow, thereby raising an attached pool cover to a sufficient height in order to prevent the accumulation of unwanted debris. Accordingly, there is a need for a pool covering apparatus and system that solves the problems identified with conventional covers and methods

SUMMARY OF THE INVENTION

In view of the foregoing disadvantages inherent in the prior art, it has been observed that there is need for an inflatable protective cover for a swimming pool comprising a pool cover, a center pillow positioned centrally under said pool cover, an annular-shaped outer ring pillow encircling said center pillow and attachable thereto, a plurality of air distribution conduits providing a fluid communication of said outer ring pillow with said center pillow and, a means to secure said pool cover thereto an exterior location.

Such a pool cover is designed wherein the center pillow and outer ring pillow remain on a water surface of said pool, the plurality of air distribution conduits distributes air from an air supply source thereto the outer ring pillow and center pillow, the center pillow and outer ring pillow raise the pool cover to a height above the water surface and, the pool cover impels objects such as rain, snow, leaves, or debris such that the objects will not collect and accumulate thereon the pool cover.

An object of the present invention provides for such a pool cover to further comprise a shape and size particularly for swimming pools having a bottom floor and cylindrically-shaped wall or barrier, with a top peripheral rim positioned at an upper portion of said swimming pool comprises; wherein the pool cover covers the water surface and is manufactured using weatherproof and waterproof materials.

A further object of the present invention provides for a plurality of inner attachment straps and outer attachment straps comprising rectangular-shaped elements positioned so as to be affixed using fastening devices in an overlapping manner thereto the pool cover, center pillow, and outer ring pillow. Such a plurality of inner and outer attachment straps comprise similar materials as the pool cover and provide an airtight means for the protective cover to substantially remain in a stationary position thereover the water surface at a substantially constant height. Also the pool cover, center pillow, outer ring pillow, plurality of air distribution conduits, and air inlet conduit, each comprise an airtight construction prohibiting escape of air between seams formed therebetween.

Additionally, the present invention may utilize a plurality of outer ring pillows provided for larger sized pools, comprising multiple pluralities of air distribution conduits and inner and outer attachment straps.

Another object of the present invention provides for the air distribution conduits each to comprise a first distal end in fluid communication with the center pillow located at a median height thereupon, and a first proximal end in fluid communication with the outer ring pillow. Such first distal and proximal ends would each have an open-air connection such that the first proximal end thereof would receive air therefrom the outer ring pillow and distribute therethrough the air distribution conduits thereto the center pillow via the first distal end.

Yet another object of the present invention provides for an air inlet conduit for providing an attachment means thereto the air supply source at a second proximal end and provides fluid communication thereto the outer ring pillow at a second distal end. Such an air inlet conduit provides the center pillow and the outer ring pillow with a sufficient amount of pressurized air.

An air cap is removably attached thereto the air inlet conduit at the second proximal end. The air inlet conduit with the air cap comprises a sufficient length such that the air inlet conduit extends at least thereto a top outer edge of the pool for easy access for inflation and deflation of the protective cover.

Still yet another object of the present invention provides the air supply source to further comprise a pressurized air generator for generating a flow of pressurized air, a flexible air hose removably attachable thereto the second proximal end of the air inlet conduit via an air cuff, a power cord, a power supply for supplying power thereto the pressurized air generator, and an ON/OFF control switch for controlling said power supply. Such an air hose directs pressurized air therefrom the air supply source thereto the protective cover wherein the outer ring pillow and the center pillow become progressively and uniformly expanded thereby forming an arcuate surface thereupon the pool cover.

Another object of the present invention provides for such an air supply source to further comprise a 110-volt AC high-volume/low-pressure unit.

Another object of the present invention provides for a plurality of equidistantly-spaced securing eyelets therealong an outer perimeter region of the pool cover, wherein the securing eyelets provide a means to affix the protective cover thereto a stationary feature with a securing element to produce a uniform taut surface during use.

Yet another object of the present invention provides such a securing element to be one of the following list: rope, cord, bungee cord, or strapping device.

Yet another object of the present invention vides such a securing element to be a weighted element.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
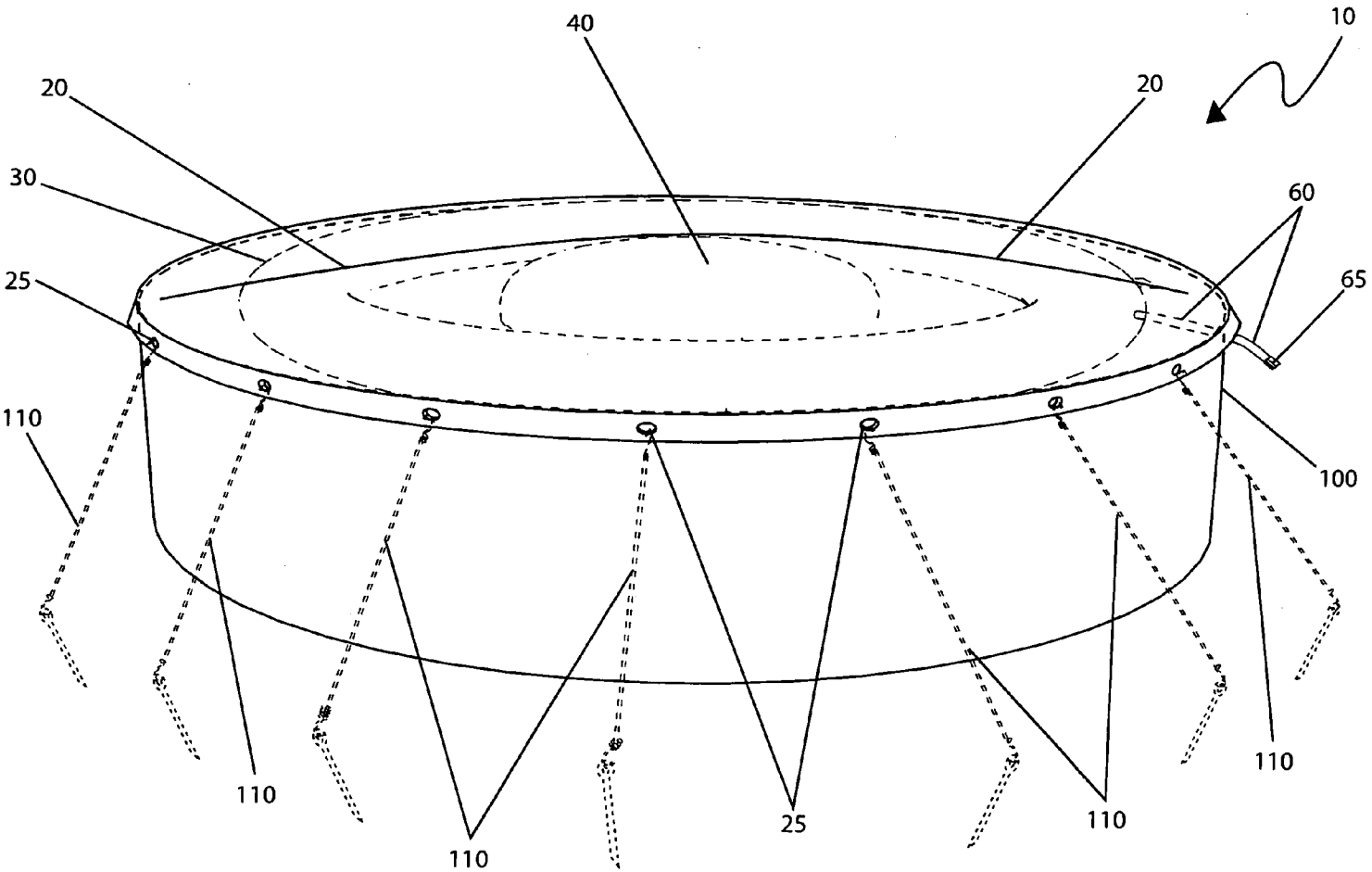
FIG. 1 is an environmental view of an inflatable safety swimming pool cover 10, according to a preferred embodiment of the present invention.

10 inflatable safety swimming pool cover
20 pool cover
25 securing eyelet
30 outer ring air pillow
35 air distribution conduit
40 center air pillow
50 inner attachment strap
55 outer attachment strap
60 air inlet conduit
65 cap
70 air blower
71 air hose
72 air cuff
73 power cord
74 ON/OFF switch
100 pool
105 pool water surface
110 tie strap

DETAILED DESCRIPTION OF THE PREFERRED EMBODIMENT

Figure 2:
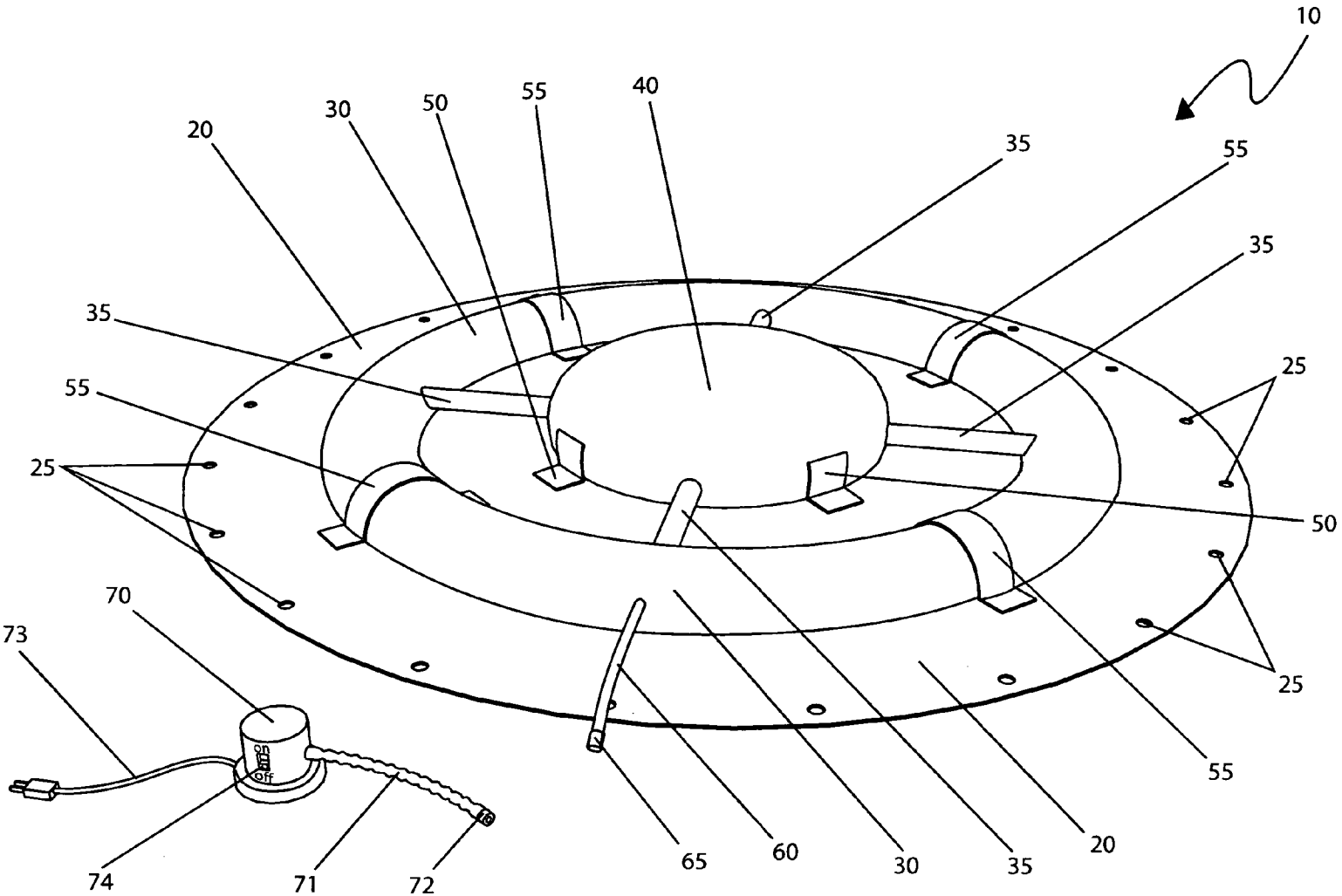
FIG. 2 is an inverted perspective view of an inflatable safety swimming pool cover 10, according to a preferred embodiment of the present invention; and, FIG. 3 is a section view of an inflatable safety swimming pool cover 10 taken along a vertical centerline, according to a preferred embodiment of the present invention.
Figure 3:
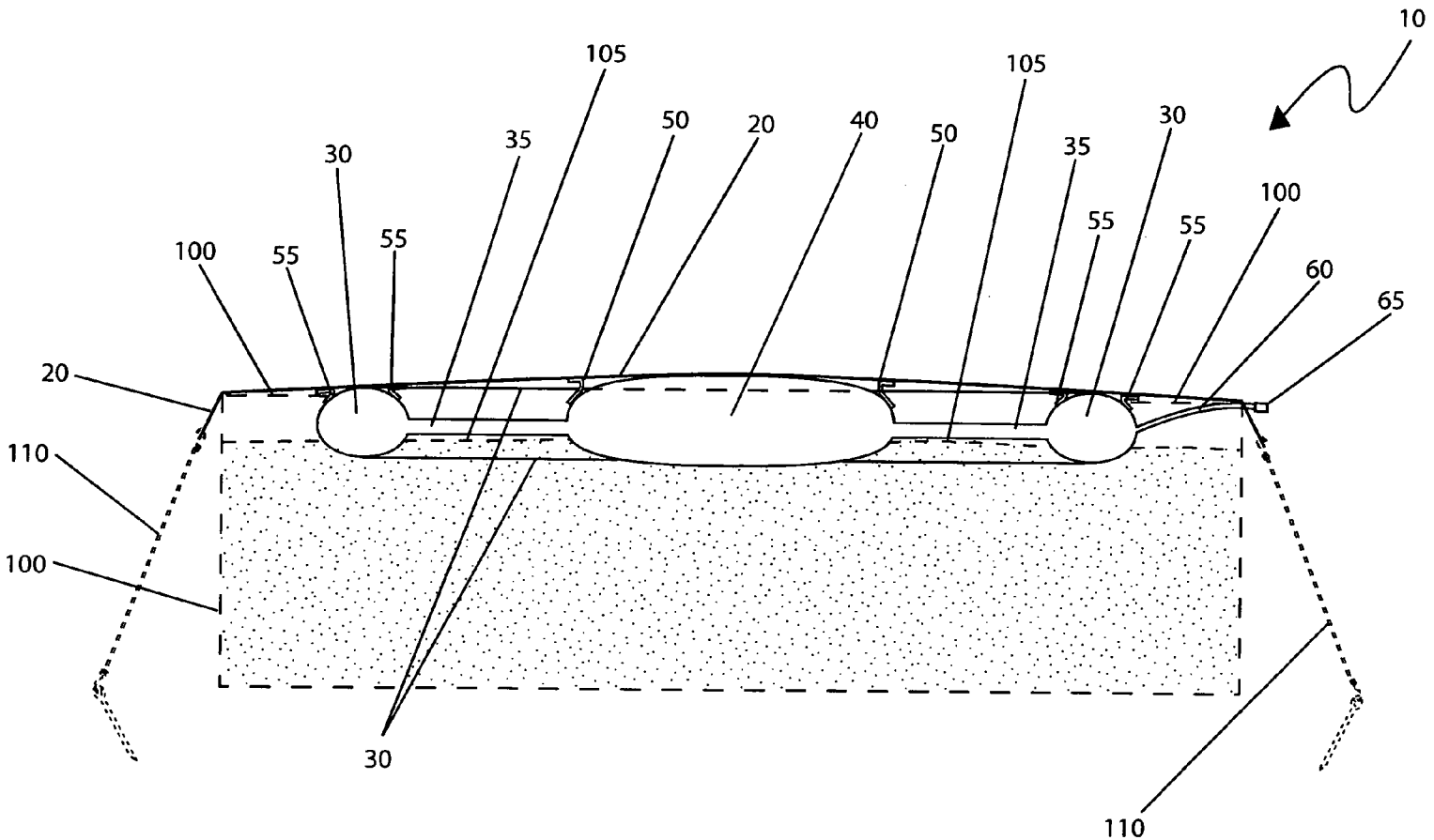

The best mode for carrying out the invention is presented in terms of its preferred embodiment, herein depicted within FIGS. 1 through 2*b* and as alternate embodiments as depicted in FIGS. 3 and 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for an inflatable safety swimming pool cover that is elevated above a pool water surface 105, preferably for an above ground pool 100. The inflatable safety swimming pool cover (herein described as the "apparatus") 10 comprises an air inlet conduit 60, a plurality of air distribution conduits 35, an outer ring air pillow 30, a center air pillow 40, and a pool cover 20. The apparatus 10 would be made of plastic tarpaulin materials as used in conventional pool covers. The air pillows 30, 40 and interconnecting air distribution conduits 35 are interconnected via a heat welding process and/or adhesives. The structure of the apparatus 10 is capable of absorbing pressures resulting from freezing and expansion of pool water 105 during storage period. The apparatus 10 further provides an electric air blower 70 inflating means.

Referring now to FIG. 1, an environmental view of the apparatus 10, according to the preferred embodiment of the present invention, is disclosed. The apparatus 10 is envisioned to attach thereto an above-ground swimming pool 60, having a bottom floor and cylindrically-shaped wall or barrier, with a top peripheral rim positioned at an upper portion of said swimming pool 60. The apparatus 10 is illustrated here depicting a circular pool 100 embodiment; however, it is envisioned that the apparatus 10 be introduced in various sizes corresponding to standard pool sizes, diameters, and shapes, such as, but not limited to, round, rectangular, oval, oblong, and/or other shaped pools 100 in a variety of, or combination of, colors with or without decorative motifs, and as such, should not be interpreted as a limiting factor of the present invention 10. The outer ring pillow 30 and/or the center air pillow 40 would accordingly be designed to fit alternate pool 60 shapes, i.e. for a rectangular pool 100, the outer ring air pillow 30 may be in a rectangular shape.

A center air pillow 40 is envisioned to be in a circular fashion, but may be in a variety of shapes suitable for operation of the apparatus 10. The center air pillow 40 is positioned centrally under a pool cover 20. The apparatus 10 comprises a donut-shaped outer ring air pillow 30 encircling the higher center pillow 40. The center air pillow 40 and the outer ring air pillow 30 are envisioned to remain on the surface of the pool water surface 105 and underneath a pool cover 20. This configuration elevates the pool cover 20 centrally above the levels of the sidewalls of the pool 100 so as to impel objects such as rain, snow, leaves, or debris to fall off the pool cover 20 and onto a surrounding ground surface such that said objects will not collect and accumulate thereon the pool cover 20. The apparatus 10 is depicted here providing a single outer ring air pillow 30; however, it is understood that additional circumscribed outer ring air pillows 30 may be provided for large pools 100 without deviating from the basic concept and as such should not be interpreted as a limiting factor of the present invention 10.

The pool cover 20 is envisioned to cover the entire water surface 105 and manufactured using weatherproof and/or waterproof materials such as, but not limited to; polyethylene, vinyl, or the like. The pool cover portion 20 further comprises a plurality of securing eyelets 25 along an outer perimeter region being equidistantly-spaced and positioned such that said securing eyelets 25 are not too close to the edge and easily ripped out by wind or other forces. The securing eyelets 25 are envisioned to be made of plastic or metal rings attached thereto said pool cover 20 using heat welding, adhesives, swaging, or the like. The securing eyelets 25 provide a means to affix the apparatus 10 thereto stationary features such as a pool body 100, a surrounding deck, a pool rim, and/or a ground surface therefrom multiple points along said perimeter of the pool cover 20 to produce a uniform taut surface during use. It is envisioned that the securing eyelets 25 would utilize securing elements such as rope, flexible strapping, cord, or the like in an expected manner. Alternatively, the apparatus 10 may utilize the securing eyelets 25 being affixed along said perimeter and tied thereto weighted objects for securement.

Referring now to FIGS. 2 and 3, an inverted perspective view and a section view taken along a vertical centerline of the apparatus 10, according to the preferred embodiment of the present invention, are disclosed. The apparatus 10 is illustrated here in an inverted position to better depict particular elements of the apparatus 10. The apparatus 10 comprises a plurality of air distribution conduits 35, a plurality of inner attachment straps 50, a plurality of outer attachment straps 55, an air inlet conduit 60, and an air blower 70.

The air distribution conduits 35 provide fluid communication and an attachment means therebetween the outer ring air pillow 30 and the center air pillow 40. The air distribution conduits 35 comprise a distal end and a proximal end. The distal ends of each air distribution conduit 35 are in fluid communication with the center air pillow 40 located at a median height thereupon. The proximal ends of each air distribution conduit 35 are in fluid communication with the outer ring air pillow 30. The distal and proximal ends would each have an open-air connection such that the proximal ends thereof would receive the air therefrom the outer pillow 30 and distribute therethrough the air distribution conduits 35 to the center pillow 40 via the distal ends until the center pillow 40 and air distribution conduits 35 are fully inflated. An air inlet conduit 60 provides an attachment means thereto an air blower 70 at a proximal end and provides fluid communication thereto the outer ring air pillow 30 at a distal end. The air inlet conduit 60, air distribution conduits 35, center air pillow 40, and outer ring air pillow 30, are of an airtight construction prohibiting escape of air between seams formed therebetween. The distal end of the air inlet conduit 60 is in fluid communication with the outer ring air pillow 30 to provide said air pillow 30 and consequently, the following air distribution conduits 35, and the center pillow 40, with a sufficient amount of air. The air inlet conduit 60 is removably attached thereto an air inlet cap 65 at a proximal end being threadingly attached thereto and sealing contained pressurized air therein the apparatus 10. The air inlet conduit 60 and the air cap 65 extend thereto a top outer edge of the pool 100 for easy access for inflation and deflation of the apparatus 10 when desirable. Although a single air inlet conduit 60 is depicted here, it will be appreciated that the apparatus 10 may provide a plurality of air inlet conduits 60 with equal benefit.

The pool cover 20 provides an attachment means thereto said air pillows 40, 30 via a plurality of inner attachment straps 50 and outer attachment straps 55, respectively, allowing the apparatus 10 to substantially remain in a stationary position over the pool water surface 105 and at a substantially constant height. Said inner 50 and outer 55 attachment straps comprise of generally rectangular-shaped elements positioned so as to be affixed in an overlapping manner thereto the pool cover 20, and the air pillows 40, 30. The inner 50 and outer 55 attachment straps are envisioned to be made using similar materials as the aforementioned pool cover 20. Attachment points therebetween the inner 50 and outer 55 attachment straps, the pool cover 20, and the air pillows 40, 30, are envisioned to be made using methods such as adhesives, snaps, heat welding, sewing, or the like, while maintaining an airtight characteristic of the air pillows 40, 30.

The air blower 70 would be utilized to inflate the air pillows 40, 30 and air distribution conduits 35 via the air inlet conduit 60. The air blower 70 further comprises an air hose 71, an air cuff 72, a power cord 73, and an ON/OFF switch 74. The air blower 70 comprises a 110-volt AC high-volume/low-pressure unit similar to devices used to inflate air mattresses being common in the industry. The air blower 70 would be removably attachable thereto a proximal threaded region of the air inlet conduit 60 via a flexible corrugated air hose 71 and a threaded cuff 72. The cuff 72 comprises a cylindrical shape being permanently affixed thereto an end of the air hose 71 and further comprising an internal female threaded region. The air hose 71 and threaded cuff 72 are envisioned to be made of plastic or rubber materials in a similar manner as common vacuum cleaner components. Once affixed, the air hose 71 is in fluid communication with the air inlet conduit 60 being threadingly removably sealed thereupon for receiving pressurized air therefrom the air blower 70. The power cord 73 and ON/OFF switch 74 provide an electrical current control means thereto a 110-volt power source thereto said air blower 70 in a conventional manner. When the air blower 70 is actuated via the ON/OFF switch 74, pressured air flows therethrough the air hose 71 and air inlet conduit 60 flowing therein the outer ring air pillow 30, further continuing to the center air pillow 40 via the air distribution conduits 35. The air blower 70 provides a sufficient motor torque and effluence capacity varying in a corresponding manner thereto the size of the apparatus 10. During inflation, the air pillows 40, 30 become progressively and uniformly expanded thereby forming an arcuate surface thereupon the pool cover 20. It is understood that the air blower 70 may also comprise a pump, compressor, blower, or other applicable air delivery device without deviating from the basic concept and as such should not be interpreted as a limiting factor of the present invention 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: placing the apparatus 10 on a water surface 105 of a swimming pool 100, such that the center air pillow 40 is positioned in the center of the pool 100 with the outer ring air pillow 30 encircling said center air pillow 40 being interconnected via air distribution conduits 35 in an un-inflated condition; securing the pool cover portion 20 about a perimeter of said pool 100 thereon using the securing eyelets 25 and securing said pool cover 20 thereto a location outside of the pool 100 via a series of straps, rope, bungee cords, or other applicable devices disposed evenly around the pool 100; threadingly securing the air cuff 72 portion of the air blower 70 thereto the threaded proximal end of the air inlet conduit 60 by turning in a clockwise direction thereupon; providing electrical power thereto the air blower 70 using the power cord 73; energizing the air blower 70 by pressing the ON/OFF switch 74 thereto the ON position; inflating the air pillows 20, 30 and the air distribution conduits 35 thereto a desired volume and pool cover 20 tautness above a water surface 105; stopping a flow of pressurized air thereto the apparatus 10 by pressing the ON/OFF switch 74 thereto the OFF position; threadingly removing the air cuff 72 therefrom the air inlet conduit 60 by turning in a counter-clockwise direction thereupon; threadingly installing the cap 65 thereupon said threaded proximal end of the air inlet conduit 60; removing the cap 65, thereby allowing said air to dissipate therefrom at the conclusion of a pool storage period; releasing an internal pressurized air volume within the apparatus 10; and, benefiting from elimination of unwanted leaves, debris and rain water collecting upon one's pool cover 20, while appreciating increased safety while utilizing the present invention 10.

The apparatus 10 is placed evenly over the pool surface 105 to evenly overlay the pool 100. Once inflated, the apparatus 10 stationarily floats on the surface of the water 105 being stabilized such to prevent rotation or other movements. The pool cover 20 will rise under the interior air pressure therein the air pillows 40, 30 and inlet distribution conduits 35 and assume a bulbous shape. The apparatus 10 is sized and shaped to fully cover the entire water surface 105 of the pool 100.

In the assembled state, the apparatus 10 is elevated such to allow rainwater, snow, and ice to run off of edges of the pool 100 as well as keeping leaves, twigs, and other debris from collecting on its surface, achieved by having the center of the pool cover 20 higher than the pool rim. This configuration of the apparatus 10 averts collected pockets of rain, snow, leaves, twigs and such thereby avoiding the need of siphoning or cleaning of pool 100 while providing safety for animals, children, and such.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An inflatable protective cover in combination with a swimming pool, said swimming pool having a bottom floor, a cylindrically-shaped wall or barrier extending upwardly therefrom, an open top with a top peripheral rim positioned at an upper portion of said swimming pool comprises:

a pool cover covering said open top;

a center pillow positioned centrally under said pool cover;

an annular-shaped outer ring pillow encircling said center pillow and attachable thereto;

a plurality of air distribution conduits providing a fluid communication of said outer ring pillow with said center pillow;

a means to secure said pool cover thereto an exterior location;

wherein said center pillow and outer ring pillow remain on a water surface at said open top of said pool;

wherein said plurality of air distribution conduits distributes air from an air supply source thereto said outer ring pillow and said center pillow;

wherein said center pillow and outer ring pillow raise said pool cover to a height thereabove said water surface, wherein said pool cover impels objects such as rain, snow, leaves, or debris such that said objects will not collect and accumulate thereon said pool cover, wherein said pool cover further comprises a shape and size to cover said water surface and manufactured using weatherproof and waterproof materials, wherein said outer ring pillow is attachable thereto said center pillow with a plurality of inner attachment straps and outer attachment straps comprising rectangular-shaped elements positioned so as to be affixed in an overlapping manner thereto said pool cover, said center pillow, and said outer ring pillow;

wherein said inner attachment straps and said outer attachment straps are comprise similar materials as said pool cover; and, wherein said inner attachment straps and outer attachment straps provide an airtight means for said protective cover to substantially remain in a stationary position thereover said water surface at a substantially constant height, wherein said the inner attachment straps and outer attachment straps are attached thereto said pool cover, said center pillow, and said outer ring pillow using fastening devices, wherein said air distribution conduits each comprises:

a first distal end, wherein said first distal end is in fluid communication with said center pillow located at a median height thereupon;

a first proximal end, wherein said first proximal end is in fluid communication with said outer ring pillow; and, an air inlet conduit for providing an attachment means thereto said air supply source at a second proximal end and provides fluid communication thereto said outer ring pillow at a second distal end;

wherein said distal and proximal ends each having an open-air connection such that said first proximal end thereof receives air therefrom said outer ring pillow and distribute therethrough said air distribution conduits thereto said center pillow via said first distal end; and, wherein said air inlet conduit provides said center pillow and said outer ring pillow with a sufficient amount of pressurized air, wherein said air inlet conduit is removably attached thereto an air cap at said second proximal end and comprising a sufficient length such that said air inlet conduit and said air cap extend at least thereto a top outer edge of said pool for easy access for inflation and deflation of said protective cover, wherein said pool cover, said center pillow, said outer ring pillow, said plurality of air distribution conduits, and said air inlet conduit, each comprises an airtight construction prohibiting escape of air between seams formed therebetween, wherein said air supply source further comprises:

a pressurized air generator for generating a flow of pressurized air;

a flexible air hose removably attachable thereto said second proximal end of said air inlet conduit via an air cuff; a power cord; a power supply for supplying power thereto said pressurized air generator; and an ON/OFF control switch for controlling said power supply; wherein said air hose is in fluid communication with said air inlet conduit when said air cuff is removably attachable thereto said inlet conduit, thereby directing pressurized air therefrom said air supply source thereto said protective cover;

wherein said pressurized air flows therethrough said air hose and said air inlet conduit thereto said outer ring pillow, said air distribution conduits, and said center pillow; and, wherein said outer ring pillow and said center pillow become progressively and uniformly expanded thereby forming an arcuate surface thereupon said pool cover, wherein said air supply source further comprises a 110-volt AC high-volume/low-pressure unit, wherein said pool cover further comprises a plurality of securing eyelets therealong an outer perimeter region being equidistantly-spaced, wherein said securing eyelets provide a means to affix said protective cover thereto a stationary feature with securing elements to produce a uniform taut surface during use, wherein said securing elements are one of the following list: ropes, cords, bungee cords, strapping devices, or a weighted elements.

2. A method of installing and inflating an inflatable protective cover in combination with a swimming pool, said swimming pool having a bottom floor, a cylindrically-shaped wall or barrier extending upwardly therefrom, an open top with a top peripheral rim positioned at an upper portion of said swimming pool, the method comprises the steps of:

providing the inflatable protective cover having:

a pool cover covering said open top;

a center pillow positioned centrally under said pool cover;

an annular-shaped outer ring pillow encircling said center pillow and attachable thereto;

a plurality of air distribution conduits providing a fluid communication of said outer ring pillow with said center pillow; and, a means to secure said pool cover thereto an exterior location;

wherein said center pillow and outer ring pillow remain on a water surface at said open top of said pool;

wherein said plurality of air distribution conduits distributes air from an air supply source thereto said outer ring pillow and said center pillow;

wherein said center pillow and outer ring pillow raise said pool cover to a height thereabove said water surface, wherein said pool cover impels objects such as rain, snow, leaves, or debris such that said objects will not collect and accumulate thereon said pool cover, wherein said pool cover further comprises a shape and size to cover said water surface and manufactured using weatherproof and waterproof materials, wherein said outer ring pillow is attachable thereto said center pillow with a plurality of inner attachment straps and outer attachment straps comprising rectangular-shaped elements positioned so as to be affixed in an overlapping manner thereto said pool cover, said center pillow, and said outer ring pillow;

wherein said inner attachment straps and said outer attachment straps are comprise similar materials as said pool cover; and, wherein said inner attachment straps and outer attachment straps provide an airtight means for said protective cover to substantially remain in a stationary position thereover said water surface at a substantially constant height, wherein said the inner attachment straps and outer attachment straps are attached thereto said pool cover, said center pillow, and said outer ring pillow using fastening devices, wherein said air distribution conduits each comprises:

a first distal end, wherein said first distal end is in fluid communication with said center pillow located at a median height thereupon;

a first proximal end, wherein said first proximal end is in fluid communication with said outer ring pillow; and, an air inlet conduit for providing an attachment means thereto said air supply source at a second proximal end and provides fluid communication thereto said outer ring pillow at a second distal end;

wherein said distal and proximal ends each having an open-air connection such that said first proximal end thereof receives air therefrom said outer ring pillow and distribute therethrough said air distribution conduits thereto said center pillow via said first distal end; and, wherein said air inlet conduit provides said center pillow and said outer ring pillow with a sufficient amount of pressurized air, wherein said air inlet conduit is removably attached thereto an air cap at said second proximal end and comprising a sufficient length such that said air inlet conduit and said air cap extend at least thereto a top outer edge of said pool for easy access for inflation and deflation of said protective cover, wherein said pool cover, said center pillow, said outer ring pillow, said plurality of air distribution conduits, and said air inlet conduit, each comprises an airtight construction prohibiting escape of air between seams formed therebetween, wherein said air supply source further comprises:

a pressurized air generator for generating a flow of pressurized air;

a flexible air hose removably attachable thereto said second proximal end of said air inlet conduit via an air cuff; a power cord; a power supply for supplying power thereto said pressurized air generator; and an ON/OFF control switch for controlling said power supply; wherein said air hose is in fluid communication with said air inlet conduit when said air cuff is removably attachable thereto said inlet conduit, thereby directing pressurized air therefrom said air supply source thereto said protective cover;

wherein said pressurized air flows therethrough said air hose and said air inlet conduit thereto said outer ring pillow, said air distribution conduits, and said center pillow; and, wherein said outer ring pillow and said center pillow become progressively and uniformly expanded thereby forming an arcuate surface thereupon said pool cover, wherein said air supply source further comprises a 110-volt AC high-volume/low-pressure unit, wherein said pool cover further comprises a plurality of securing eyelets therealong an outer perimeter region being equidistantly-spaced, wherein said securing eyelets provide a means to affix said protective cover thereto a stationary feature with securing elements to produce a uniform taut surface during use, wherein said securing elements are one of the following lists: ropes, cords, bungee cords, strapping devices, or weighted elements;

placing said protective pool cover thereon a water surface of a swimming pool, such that said center pillow is positioned in a center location of said swimming pool with said outer ring pillow encircling said center pillow in an un-inflated condition;

securing said pool cover thereabout a perimeter of said swimming pool using said plurality of securing eyelets thereto a location outside of said swimming pool via said securing elements disposed evenly around said swimming pool;

threadingly securing said air cuff portion of said air supply source thereto a proximal end of said air inlet conduit;

providing electrical power thereto said air supply source using said power cord;

energizing said air supply source by switching said ON/OFF control switch thereto an ON position, thereby generating a flow of pressurized air;

inflating said outer ring pillow, said air distribution conduits, and said central pillow thereto a desired volume and a desired tautness of said pool cover above said water surface;

stopping said flow of pressurized air thereto said protective cover by switching said ON/OFF control switch thereto an OFF position;

threadingly removing said air cuff from said a proximal end of said air inlet conduit;

threadingly installing said air cap thereupon said proximal end of said air inlet conduit;

preventing a build-up of debris that falls onto said pool cover during periods of inactivity;

removing said air cap, thereby allowing said air to dissipate therefrom at a conclusion of a pool storage period; and, releasing an internal pressurized air volume within said protective cover.

* * * * *